United States Patent [19]

Kranz

[11] Patent Number: 4,565,317

[45] Date of Patent: Jan. 21, 1986

[54] TWO-WAY ENVELOPE WITH INSIDE RETURN SEAL FLAP

[75] Inventor: Richard Kranz, Shawnee Mission, Kans.

[73] Assignee: Tension Envelope Corporation, Kansas City, Mo.

[21] Appl. No.: 534,371

[22] Filed: Sep. 21, 1983

[51] Int. Cl.[4] ..... B65D 27/06

[52] U.S. Cl. ..... 229/73

[58] Field of Search ..... 229/73

[56] References Cited

U.S. PATENT DOCUMENTS

| | | | |
|---|---|---|---|
| 1,064,302 | 6/1913 | Donohue | 229/73 |
| 1,145,935 | 7/1915 | Steinke | 229/73 |
| 1,373,512 | 4/1921 | Kuhhorn . | |
| 2,201,538 | 5/1940 | Holden . | |
| 2,317,335 | 4/1943 | Whitman . | |
| 2,936,946 | 5/1960 | Harpman | 229/73 |
| 3,152,751 | 10/1964 | Hiersteiner . | |
| 3,270,948 | 9/1966 | Donavan . | |
| 3,356,285 | 12/1967 | Greason . | |
| 3,498,528 | 3/1970 | Klein . | |
| 3,512,702 | 5/1970 | Pritchard, Jr. . | |
| 3,558,040 | 1/1971 | Krueger . | |
| 3,982,689 | 9/1976 | Retrum . | |
| 4,081,127 | 3/1978 | Steidinger . | |
| 4,180,168 | 12/1979 | Hiersteiner . | |
| 4,288,028 | 9/1981 | Diaz | 229/73 |
| 4,308,987 | 1/1982 | Soloman . | |
| 4,332,346 | 6/1982 | Kronman | 229/73 |
| 4,382,539 | 5/1983 | Kronman | 229/73 |
| 4,445,635 | 5/1984 | Barr | 229/73 |

FOREIGN PATENT DOCUMENTS

| | | | |
|---|---|---|---|
| 14185 | of 1903 | United Kingdom | 229/73 |

*Primary Examiner*—Stephen P. Garbe

*Attorney, Agent, or Firm*—Litman, Day and McMahon

[57] ABSTRACT

A two-way envelope includes a front panel with a window opening and a back panel connected to the front panel along a lower fold line. A pair of side flaps extend from the front panel and are secured to an inner surface of the back panel. An initial seal flap extends from an upper edge of the front panel and is demarcated therefrom by a perforated tear line. A return flap extends from an upper edge of the back panel and is demarcated therefrom by a fold line. An extension is integrally connected to the return flap along an extension fold line. The return flap and the extension are folded with respect to each other and placed within a pocket formed by the envelope for an initial mailing. For a return mailing, the return flap and the extension are placed over the front panel with the extension covering the window opening. The extension has a return address thereon.

17 Claims, 13 Drawing Figures

Fig. 4.
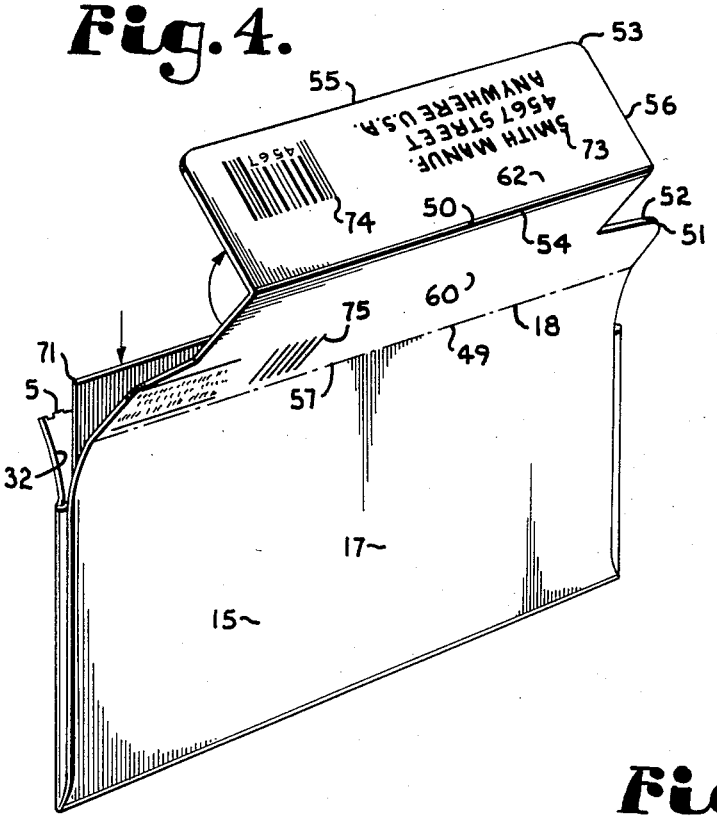
Fig. 6.
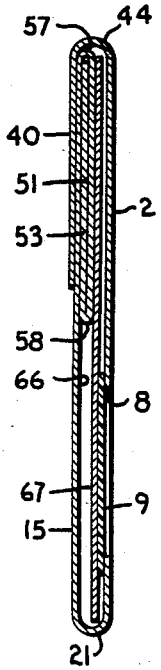
Fig. 5.
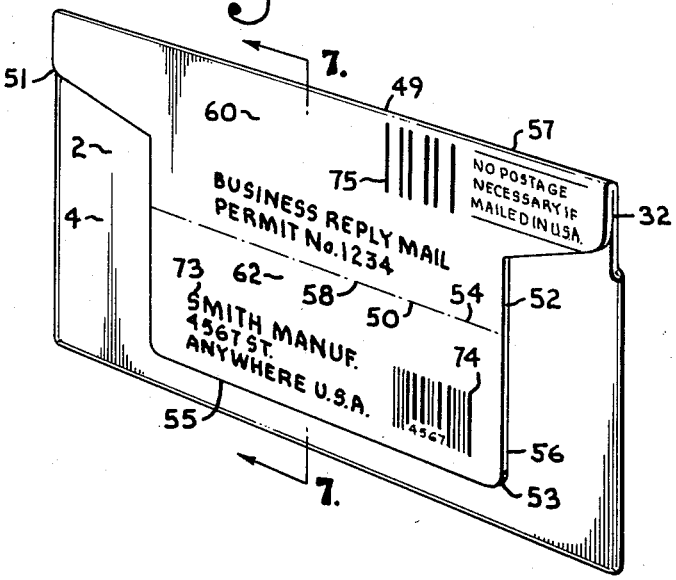
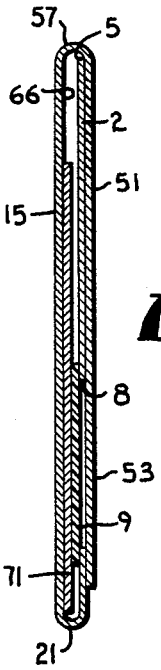
Fig. 7.
Fig. 8.
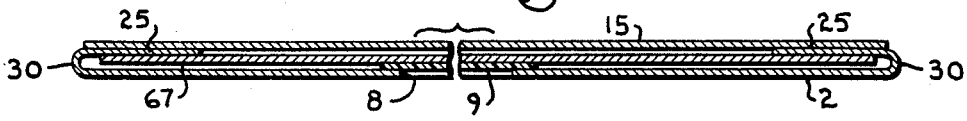

Fig. 9.
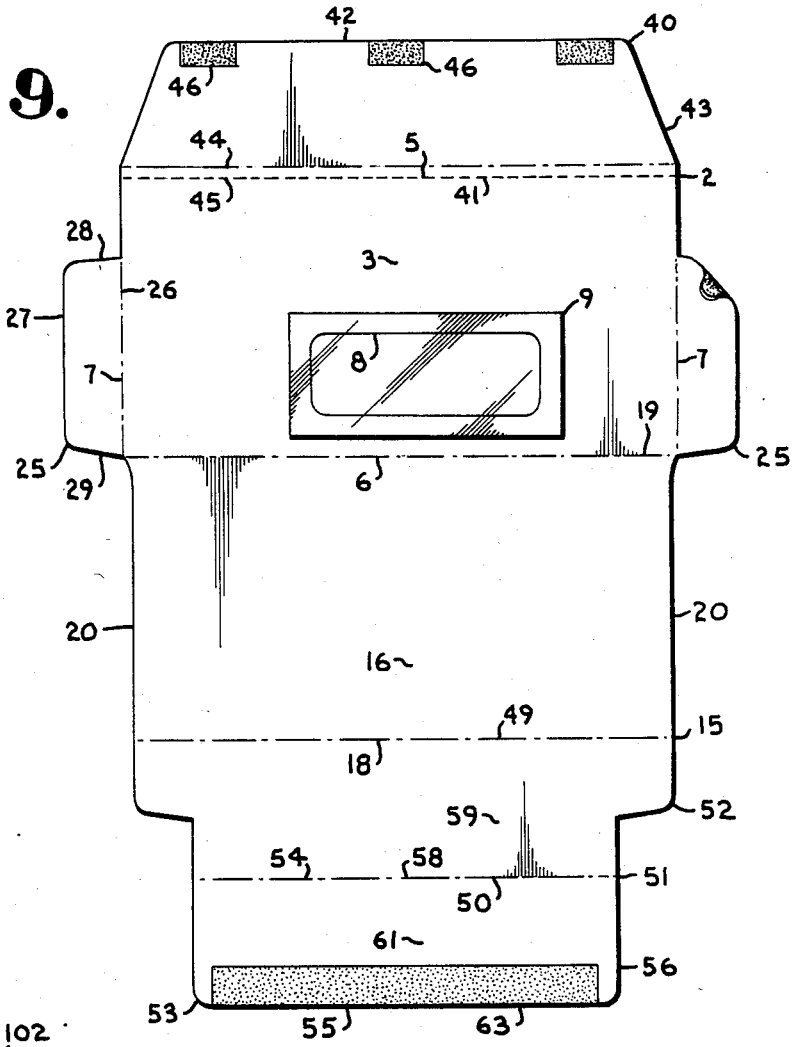
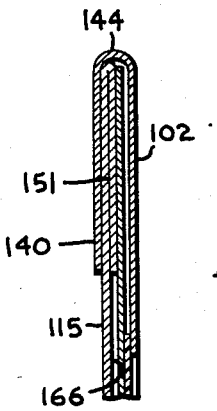
Fig. 11.
Fig. 13.
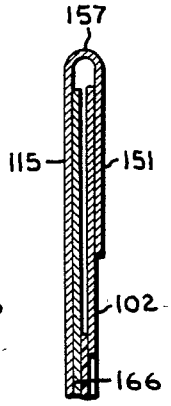
Fig. 10.
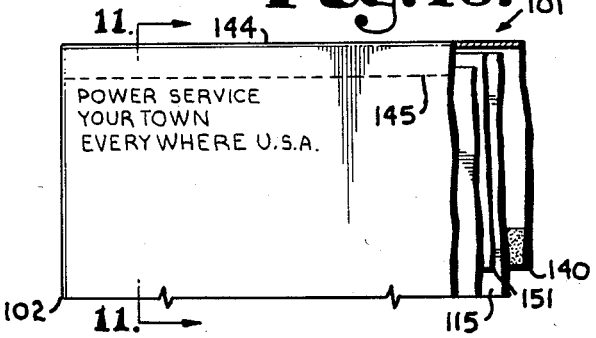
Fig. 12.
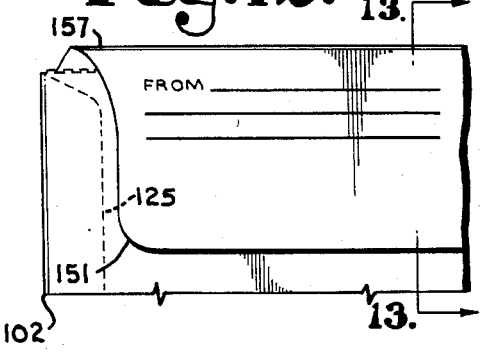

TWO-WAY ENVELOPE WITH INSIDE RETURN SEAL FLAP

BACKGROUND OF THE INVENTION

1. Field of the Invention.

This invention relates to envelopes and in particular to a two-way envelope adapted for use with automatic mail processing equipment.

2. Description of the prior art.

Two-way or returnable mailing envelopes are widely used for business transactions where a reply to an initial mailing is required. For example, many businesses send their statements in two-way envelopes which their customers use for returning payments. An exemplary two-way envelope is shown in the Hiersteiner U.S. Pat. No. 3,152,751 and includes a flap which is divided by a tear line into an initial seal flap portion and a return flap portion. Upon receipt by the initial addressee, the initial seal flap portion is detached from the envelope and the return flap portion is utilized to seal the envelope pocket for a return trip. Return addresses and postage may be applied to the flap.

Another type of two-way envelope is shown in the Hiersteiner U.S. Pat. No. 4,180,168 and includes a pair of side flaps folded over a front panel to form a pocket. The side flaps have upper portions which form a return flap for sealing the pocket for a return mailing. An initial seal flap is integral with the front panel and demarcated therefrom by a tear line. The initial seal flap is folded over the return flap for an initial mailing and is detached from the envelope by the initial addressee.

However, the U.S. Postal Service has begun using automation equipment designed to apply and read zip codes in bar format which renders many such prior art two-way envelopes obsolete. Included in the automation equipment presently in use by the U.S. Postal Service are optical character readers which read zip codes and print them in bar format on mail pieces which do not already include bar format zip codes. Bar code readers are provided for processing mail with zip codes in bar format.

For two-way mailings, the initial address including a bar format code is preferably printed on materials enclosed in the envelope and visible through a window on the front panel thereof. It is likewise desirable for a return address on a two-way envelope to include a pre-printed zip code in bar format. Furthermore, facing identification marks which identify a return mailing as courtesy reply or business reply may be required to be printed on the outside of the envelope in its return configuration for detection by the Postal Service's automatic sorting equipment.

Many prior art two-way envelopes are unsuitable for use with such automation equipment because, in their return configurations, the initial address bar code may be visible through a window opening or elsewhere on the envelope if, for example, the initial recipient fails to remove the materials with his or her address prior to a return mailing. The initial bar format zip code may then be detected by a bar code reader, routed to the initial address rather than the return address and thus be prevented from completing its round trip. In fact, a "ping-pong" effect may result with the mail piece going back and forth between the postal system and the initial addressee without ever returning to the initial sender.

Such mail pieces may ultimately be lost or at least delayed in reaching their intended destinations.

A related problem occurs if a facing identification mark appropriate only to the return trip is visible during the initial trip and is detected by an optical code reader. Also, many prior art two-way envelopes did not provide sufficient space for printing a return address with a zip code in bar format and the aforementioned facing identification marks.

The aforementioned problems may occur even with two-way mailings which are presorted to carrier routes for a first mailing. Although automatic processing equipment is thus avoided for an initial mailing, it may be encountered during a return mailing. If incorrect bar format zip codes or inappropriate facing identification marks are present, they may be detected by optical character readers or bar code readers and the mail pieces may be lost or delayed from reaching their destinations. Heretofore, there has not been available a two-way envelope particularly compatible with the Postal Service's automatic mail processing equipment with the features and advantages of the present invention.

SUMMARY OF THE INVENTION

In the practice of the present invention, a two-way envelope is provided which avoids the aforementioned problems. The two-way envelope includes a front panel with a window opening. A back panel is integrally connected to the front panel and demarcated therefrom by a lower fold line. Side flaps extend from the front panel and are adhesively connected to the back panel. An initial seal flap is connected to the front panel along a perforated tear line. A return flap is integrally connected to the back panel and demarcated therefrom by a return flap fold line. An extension extends from the return flap and is foldable with respect thereto for insertion in a pocket of the envelope for an initial mailing. With the return flap and the extension folded with respect to each other for an initial mailing, interference with automatic insertion equipment for stuffing the envelopes is avoided. For a return mailing, the initial seal flap is detached from the back panel and torn loose from the front panel. The return flap and the extension are extracted from the pocket, and folded with respect to each other and placed over the front panel with the extension in covering relation over the window opening. Postage and facing identification marks may be applied to the return flap and a return address including a return zip code in bar format may be applied to the extension. Gaps are provided between side edges of the front and back panels to facilitate insertion and removal of the return flap and the extension.

The principal objects of the present invention are: to provide a two-way envelope; to provide such an envelope which is particularly well adapted for use with automatic mail processing equipment; to provide such an envelope which includes a return flap and an extension foldably connected thereto; to provide such an envelope wherein the extension is adapted for covering a window opening in a front panel of the envelope; to provide such an envelope wherein the extension may have a return address including a return zip code in bar format printed thereon; to provide such an envelope wherein the return flap and extension are folded with respect to each other and inserted in a pocket thereof for an initial mailing; to provide such an envelope with an initial seal flap which is separable therefrom along a tear line; to provide such an envelope which is compatible for use with automatic envelope stuffing equipment; to provide such an envelope which is simple and inexpensive to produce on conventional rotary envelope folding equipment; and to provide such an envelope which is easy to use, relatively inexpensive, and efficient in operation.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a rear perspective view of the envelope showing a return flap and an extension extracted from a pocket of the envelope and being unfolded with respect to each other.

FIG. 5 is a front perspective view of the envelope in its return mailing configuration.

FIG. 6 is a cross-sectional view of the envelope taken generally along line 6—6 in FIG. 1.

FIG. 7 is a cross-sectional view of the envelope taken generally along line 7—7 in FIG. 5.

FIG. 8 is a cross-sectional view of the envelope taken generally along line 8—8 in FIG. 1.

FIG. 9 is a plan view of a blank for forming the envelope.

FIG. 10 is an enlarged, front elevational view of an envelope comprising a modified embodiment of the present invention.

FIG. 11 is a cross-sectional view of the modified envelope taken generally along line 11—11 in FIG. 10.

FIG. 12 is an enlarged front elevational view of the modified envelope in its return configuration.

FIG. 13 is a cross-sectional view of the modified envelope taken generally along line 13—13 in FIG. 12.

DETAILED DESCRIPTION OF THE INVENTION

Figure 1:
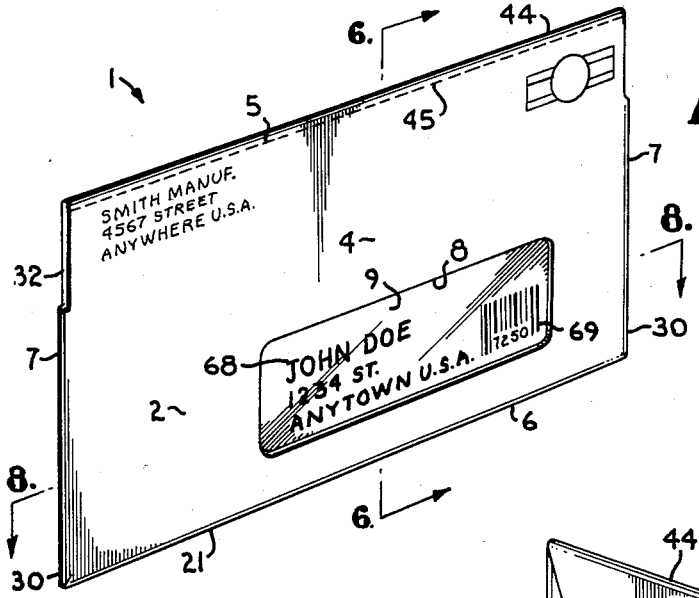
FIG. 1 is a front perspective view of a two-way envelope embodying the present invention.
Figure 2:
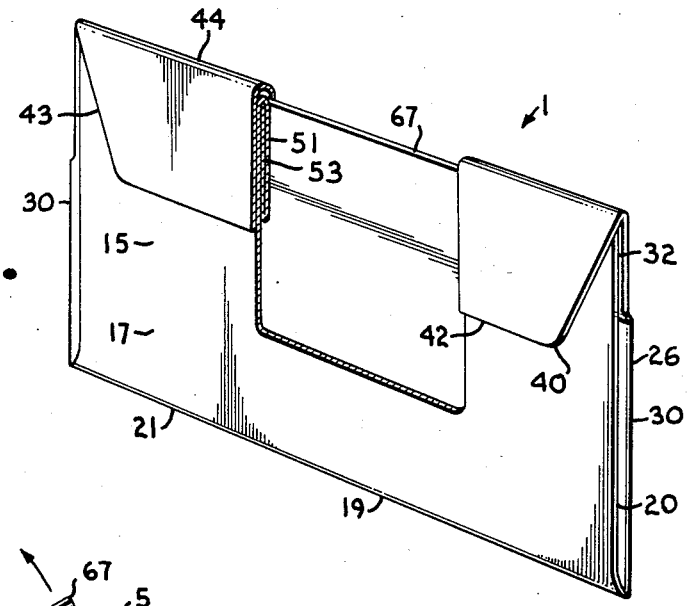
FIG. 2 is a rear perspective view of the two-way envelope with portions broken away to reveal the internal construction thereof.
Figure 3:
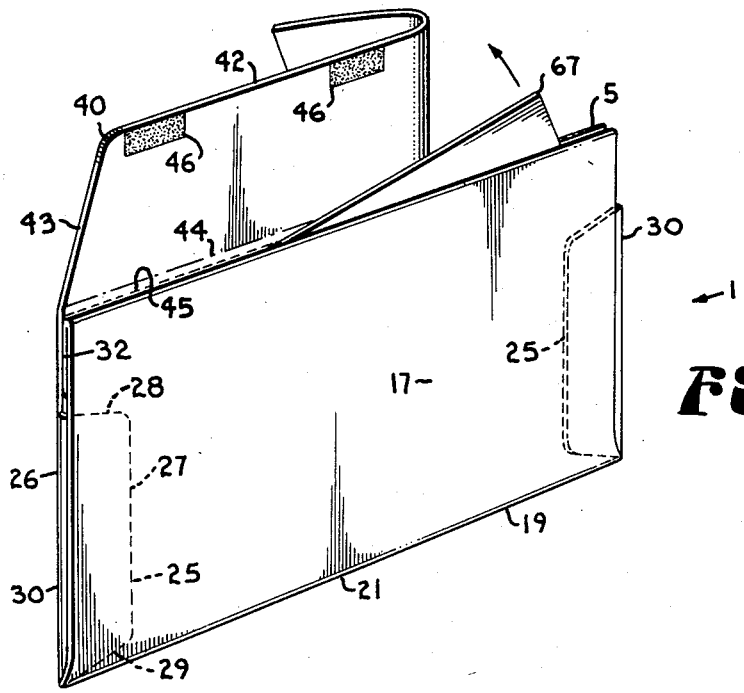
FIG. 3 is a rear perspective view of the envelope showing an initial seal flap being removed therefrom.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a two-way, or return envelope embodying the present invention. The envelope 1 includes a front panel 2 with inner and outer surfaces 3, 4. The front panel 1 includes upper, lower and side edges 5, 6 and 7 respectively. A window opening 8 extends through the front panel 2 and is covered by a transparent plastic window patch 9 adhesively secured to the front panel inner surface 3.

A back panel 15 includes inner and outer surfaces 16, 17 and upper, lower and side edges 18, 19 and 20 respectively. The back panel 15 is integrally connected to and demarcated from the front panel 2 by a lower fold line 21 at the panel lower edges 6, 19. A pair of side flaps 25 each includes proximate and distal side edges 26, 27 and upper and lower ends 28, 29. The side flaps 25 are integrally connected to the front panel 2 and demarcated therefrom by side flap fold lines 30 extending along respective side flap proximate edges 26 and partially along respective front panel side edges 7. The side flaps 25 are secured to the back panel inner surface 16 by adhesive strips 31. The side flap upper ends 28 terminate in spaced relation below the front and back panel upper edges 5, 18 whereby gaps or side openings 32 are formed between upper portions of the front and back panel side edges 7, 20 for purposes which will be explained more fully hereinafter.

An initial seal flap 40 includes proximate, distal and side edges 41, 42 and 43 and a fold line 44 extending parallel to the proximate and distal edges 41, 42 in closely spaced relation to the proximate edge 41. The front panel 2 and initial seal flap 40 are connected at their respective upper and proximate edges 5, 41 at a perforated tear line 45. A plurality of discrete adhesive spots 46 are provided on the initial seal flap 40 adjacent its distal edge 41 for releasable attachment to the back panel outer surface 17 for an initial mailing.

A return flap 51 includes proximate, distal and side edges 49, 50, 52 and inner and outer surfaces 59, 60. The return flap 51 is integrally connected to the back panel 15 and demarcated therefrom by a return flap fold line 57 extending along the back panel upper and return flap proximate edges 18, 49. The return flap side edges 52 are spaced apart more widely adjacent the return flap fold line 57 than adjacent the return flap distal edge 50.

An extension 53 includes proximate, distal and side edges 54, 55 and 56 and inner and outer surfaces 61, 62. The extension is integrally connected to the return flap and demarcated therefrom by an extension fold line 58 extending along the return flap distal and extension proximate edges 50, 54 in parallel, spaced relation to the return flap fold line 57. The extension side edges 56 are spaced approximately as far apart as the return flap side edges 52 adjacent the extension fold line 58. An adhesive strip 63 is applied to the extension inner surface 61 along the extension distal edge 55.

In forming the envelope 1, a single-piece blank 64 (FIG. 9) is cut from paper stock in a conventional manner. Suitable adhesive is applied to the blank 64 at 31, 46 and 61. The window patch 9 is adhesively applied to the front panel inner surface 3 in covering relation over the window opening 8. The return flap 51 is then folded along the extension fold line 58 so that the return flap and the extension inner surfaces 59, 61 are in opposed relation. The return flap 51 and the extension 53 are then folded into a pocket 66 formed between the front and back panel inner surfaces 3, 16 at the return flap fold line 57. The extension outer surface 62 is thus positioned in opposed relation to the back panel inner surface 16. The two-way envelope 1 is now in a preferred configuration for the insertion of initial material 67, for example by automatic insertion equipment, without inteference from the extension 53.

Placement of the return flap and extension 51 and 53 within the pocket 66 is facilitated by the gaps 32 which allow the front and back panel side edges 5, 18 to be spread relatively far apart. Also, insertion of the initial material 67 is facilitated by spreading the panel upper edges 5, 18 as permitted by the gaps 32.

With the material 67 positioned in the pocket 66, an initial address 68 printed thereon including an initial bar code indicia 69 is visible through the window patch 9. The initial seal flap 40 is adhesively attached to the back panel outer surface 7, postage is applied and the envelope 1 is ready for an initial mailing.

Upon receipt of the envelope 1, the initial addressee pries the initial seal flap 40 loose from the back panel outer surface 17 at the adhesive spots 46, tears the initial seal flap 40 from the front panel 2 at the perforated tear line 45 and extracts the initial material 67. The return flap 51 and the extension 53 are also extracted from the pocket 66 and unfolded. The initial addressee then inserts into the pocket 66 return material 71 which may comprise, for example, a payment, an order, information requested by the initial addressee or any other type of reply which may be handled by two-way mail communications.

The pocket 66 is then resealed for a return trip by folding the return flap 51 and the extension 53 over the front panel outer surface 4 along the return flap fold line 57. The extension is secured to the front panel outer surface 4 by adhesive strip 63. With the two-way envelope 1 in its configuration for the return trip, the extension 53 covers the window opening 8 to avoid any possibility of the initial address 68 and its bar format zip code 69 appearing on the outside of the envelope 1. Therefore, if the initial recipient inadvertently leaves the initial material 67 in its original position, the initial address 68 displayed through the window opening 8 will be covered and will not affect the return routing of the envelope 1.

The extension 53 has a return address 73 printed thereon including a return bar code indicia 74. Facing identification marks 75 indicating the nature of the return mailing as business or courtesy reply mail are printed on the return flap outer surface 60. Since the return address 73 and the return facing identification marks 75 are positioned within the pocket 66 for the initial trip, they are not visible from the outside of the envelope 1 in its initial mailing configuration and thus cannot cause the envelope 1 to be misdirected.

The extension 53 serves two very important functions in a two-way mail transaction. First of all, the extension 53 covers the window opening 8 and thus obscures any material within the pocket 66 which might misdirect the envelope 1 on its return trip, particularly the initial address 68 on the initial material 67. Secondly, the extension outer surface 62 provides a place for preprinting the return address 73 so that it will be properly located in a position relative to the front panel 2 corresponding to that of the window opening 8 through which the initial address 68 was visible.

The two-way envelope of the present invention is particularly well adapted for use with automatic mail processing equipment used by the U.S. Postal Service. Zip codes printed as bar codes are detected by bar code readers. Opitical character readers determine from the facing identification marks whether or not a preprinted zip code in bar format is present on the envelope and also the nature of the mail piece. If the zip code is not present in bar format, the optical character reader prints it on the envelope.

The use of such automatic mail processing equipment poses particular problems for two-way mailings. For example, if the initial zip code in bar format shows on the return trip, the mail piece may be routed back to the initial address. The facing identification marks should likewise be visible only for that portion of the envelope's trip to which they are applicable. The two-way envelope 1 of the present invention avoids the aforementioned problems by providing a return flap 51 and extension 53 which, in their respective positions for a return mailing, prevent the initial address 68 and the initial facing identification marks 70 from being visible.

Although the initial seal flap 40 is designated to be removed along the perforated tear line 45 after the initial trip, if the initial addressee neglects to do this, it may be folded between the front panel outer surface 4 and the return flap 51 or into the pocket 66 for a return mailing. In either case, it will not hinder the return mailing of the envelope 1. The perforated tear line 45 and the return flap fold line 57 are substantially colinear. The seal flap fold line 44 is spaced toward the seal flap distal edge 42 so that the seal flap 40 is easily folded over the back panel upper edge 18 for an initial trip. The gaps 32 are adapted to allow a letter opener (not shown) to be easily inserted into the pocket 66 for opening the envelope 2 after an initial or a return mailing. Alternatively, since the return flap 51 and a portion of the extension 53 are not directly attached to the front panel 2 for a return mailing, a letter opener may be inserted anywhere above the adhesive strip 63 to open the envelope 1 after a return trip.

A two-way envelope comprising a modified embodiment of the present invention is shown in FIGS. 10 through 13 and generally designated by the reference numeral 101. The envelope 101 includes a front panel 102 integrally connected to a back panel 115 and a pair of side flaps 125. An initial seal flap 140 is integrally connected to the front panel 102 and demarcated therefrom by a perforated tear line 145. The initial seal flap 140 also includes a seal flap fold line 144 extending parallel to and slightly spaced from the perforated tear line 145. A return flap 151 is integrally connected to the back panel 115 and demarcated therefrom by a return flap fold line 157.

In use, the return flap 151 is positioned within a pocket 166 formed between the front and back panels 102, 115 for an initial mailing. The initial seal flap 140 is folded along the initial seal flap fold line 144 and adhesively attached to the back panel 115. The initial addressee detaches the initial seal flap 140 from the back panel 115 and removes it from the envelope 101 by tearing along the perforated tear line 145. The envelope 101 may be resealed for a return trip by extracting the return flap 151 from the pocket 166 and adhesively attaching it to the envelope front panel 102.

It is to be understood that while certain forms of the present invention have been illustrated and described herein, it is not to be limited to the specific forms or arrangement of parts described and shown.

What is claimed and desired to be secured by Letters Patent is as follows:

1. A two-way envelope, which comprises:

(a) a front panel having:

(1) inner and outer surfaces; and (2) upper, lower and side edges;

(b) a back panel having:

(1) inner and outer surfaces; and (2) upper, lower and side edges;

(c) said back panel being integrally connected to said front panel and demarcated therefrom by a lower fold line extending along said front and back panel lower edges;

(d) an initial seal flap integrally connected to said front panel by an initial seal flap tear line extending along said front panel, said initial seal flap tear line at least in part being closely spaced to said back panel upper edge;

(e) a return flap having proximate, distal and side edges, said return flap being integrally connected to said back panel and demarcated therefrom by a return flap fold line extending along said back panel upper and said return flap proximate edges;

(f) a return flap extension having proximate, distal and side edges, said return flap extension being integrally connected to said return flap and demarcated therefrom by an extension fold line extending along said return flap distal and said extension proximate edges, said return flap and said extension being folded with respect to each other and positioned within said envelope; and (g) a pair of side flaps each being integrally connected to and demarcated from one of said front and back panels by a respective side flap fold line extending along a respective front or back panel side edge, each said side flap being secured to the other of said front and back panels over an area terminating below the upper edge of said other panel an amount sufficient to facilitate withdrawl of said folded return flap and extension.

2. The envelope according to claim 1, which includes:

(a) mailing materials placed in said envelope between said front panel and one of said return flap and extension.

3. The envelope according to claim 1 wherein said side flaps are integrally connected to said front panel and secured to said back panel.

4. The envelope according to claim 3 wherein said side flaps are secured to said back panel inner surface.

5. The envelope according to claim 1 wherein said extension is positioned against said back panel.

6. The envelope according to claim 1 wherein said return flap is positioned against said back panel.

7. The envelope according to claim 1 which includes:

(a) said initial seal flap having a fold line extending in closely spaced relation to said tear line.

8. The envelope according to claim 1 which includes:

(a) said tear line and said return flap fold line being colinear.

9. The envelope according to claim 1 which includes:

(a) a window opening extending through said front panel; and (b) said extension being adapted to cover said window opening.

10. The envelope according to claim 9 which includes:

(a) a return address on said extension.

11. A two-way envelope, which comprises:

(a) a front panel having:

(1) inner and outer surfaces; and (2) upper, lower and side edges;

(b) a back panel having:

(1) inner and outer surfaces; and (2) upper, lower and side edges;

(c) said back panel being integrally connected to said front panel and demarcated therefrom by a lower fold line extending along said front and back panel edges;

(d) an initial seal flap integrally connected to said panel by an initial seal flap tear line extending along said front panel, said initial seal flap tear line at least in part being closely spaced to said back panel upper edge;

(e) a return flap having proximate, distal and side edges, said return flap being integrally connected to said back panel and demarcated therefrom by a return flap fold line extending along said back panel upper and said return flap proximate edges;

(f) a return flap extension having proximate, distal and side edges, said return flap extension being integrally connected to said return flap and demarcated therefrom by an extension fold line extending along said return flap distal and said extension proximate edges, said return flap and said extension being folded with respect to each other and positioned within said envelope with said extension against said back panel;

(g) mailing materials located in said envelope between said front panel and said return flap; and (h) a pair of side flaps each being integrally connected to and demarcated from said front panel by a respective side flap fold line extending along a respective front panel side edge, each said side flap being secured to the back panel over an area terminating below the back panel upper edge an amount sufficient to permit easy withdrawl of the folded return flap and extension.

12. The envelope according to claim 11 wherein said side flaps are secured to said back panel outer surface.

13. The envelope according to claim 11 wherein said side flaps are secured to said back panel inner surface.

14. The envelope according to claim 11 wherein:

(a) said pocket is accessible by automatic insertion equipment through said front and back panel upper edges with said return flap and said extension folded between said front and back panels.

15. The envelope according to claim 11 which includes:

(a) said front panel having a window opening extending therethrough; and (b) said extension being adapted to cover said window opening.

16. The envelope according to claim 11, which includes:

(a) a return address on said extension.

17. The envelope according to claim 11, which includes:

(a) bar code indicia applied to said return flap and designating said envelope as business reply mail or courtesy reply mail.

* * * * *